US007337554B2

(12) United States Patent
Erickson

(10) Patent No.: US 7,337,554 B2
(45) Date of Patent: Mar. 4, 2008

(54) STABILITY-KERFING OF GREEN LUMBER TO OBTAIN IMPROVEMENTS IN DRYING AND FUTURE UTILIZATION

(76) Inventor: Robert William Erickson, 5558 41st Ave. South, Minneapolis, MN (US) 55417

( * ) Notice: Subject to any disclaimer, the term of this patent is extended or adjusted under 35 U.S.C. 154(b) by 55 days.

(21) Appl. No.: 11/251,714

(22) Filed: Oct. 17, 2005

(65) Prior Publication Data

US 2006/0080856 A1 Apr. 20, 2006

Related U.S. Application Data

(60) Provisional application No. 60/620,142, filed on Oct. 19, 2004.

(51) Int. Cl.
*F26B 7/00* (2006.01)

(52) U.S. Cl. ..... 34/396

(58) Field of Classification Search ..... 34/380, 34/381, 396; 83/75.5; 156/64; 144/348
See application file for complete search history.

(56) References Cited

U.S. PATENT DOCUMENTS 3,961,654 A * 6/1976 Hasenwinkle ..... 144/348
3,986,268 A * 10/1976 Koppelman ..... 34/257
2003/0010434 A1* 1/2003 Grenier ..... 156/264
2006/0054267 A1* 3/2006 Bosson ..... 156/64

* cited by examiner

*Primary Examiner*—S. Gravini
(74) *Attorney, Agent, or Firm*—Shewchuk IP Services; Jeffrey D. Shewchuk

(57) ABSTRACT

A technique for end-grain creation is employed for obtaining rapid and uniform drying of lumber while simultaneously reducing warp. The stability-kerfing responsible for the improved drying of the lumber decreases the edgewise bending strength by less than ten percent, a loss readily recovered due to the ability of stability-kerfing to achieve lower and more uniform moisture contents than those realized in the contemporary drying of lumber.

The improved moisture condition provided by the stability-kerfing also fosters future dimensional stability at the time of entry into the marketing stream compared to that for contemporary lumber. The required stability-kerfing is easily accomplished by the specialized implementation of existing saw equipment and associated technology into the contemporary processing lines.

17 Claims, 5 Drawing Sheets

Moisture content vs. drying time for kerfed red pine nominal 2 x 4 boards and unkerfed controls

STABILITY-KERFING OF GREEN LUMBER TO OBTAIN IMPROVEMENTS IN DRYING AND FUTURE UTILIZATION

BACKGROUND OF THE INVENTION

The present invention relates to the lumber industry, and particularly to cutting and/or shaping of lumber as part of the drying process and to minimize warpage.

Dimension lumber is defined in the US as lumber with a nominal thickness of from 2 inches up to 4 inches and a nominal width of 2 inches or more. Most of such lumber is of nominal 2 inch thickness. In the U.S., softwood dimension lumber in excess of 19% average moisture content ("MC") is defined as "unseasoned". Framing lumber of nominal 2 inch thickness must not exceed 19% MC to be grade stamped "S-DRY." S-DRY lumber is generally more dimensionally stable and stronger than unseasoned or green lumber and therefore commands a higher price, and significant cost and equipment has been used to attempt to rapidly and efficiently dry lumber to the S-DRY grade.

One of the primary factors hindering rapid and quality drying of softwood dimension lumber is the inherent lack of permeability of the wood. It is well accepted that moisture moves within the board parallel to the grain of the wood markedly easier than perpendicular to the grain. Moisture moving a given distance parallel to the grain encounters only a fraction of the cell wall substance encountered over the same distance perpendicular to the grain. It is stated in the literature that moisture travels about 15 to 20 times faster through end grain than side grain. For example, in an 8 foot long 2×4 board, the two ends quickly dry for some distance along the grain. In the remainder of the board, drying must occur by transmission of moisture through the side grain, i.e. perpendicular to board length. In a green 8 foot nominal 2×4 board, there is less than 13 $in^2$ of exposed end grain, but nearly 1100 $in^2$ of exposed side grain. Consequently, in spite of fast drying through the end grain, most of the overall drying must occur through side grain.

Most drying of nominal 2 inch thick dimension lumber occurs in a kiln to an average of 14 to 15% MC prior to being "surfaced four sides" (S4S) and then grade stamped. The resulting range in MC for the thousands of boards in a single kiln run is about 4% to 19%, or often higher than 19%. The pieces in the 4% to 8% range are over dried and thus have warped excessively, principally in the forms of crook, bow, and twist. With strict limits on the allowable amount of warp for a given grade of the lumber, the warp degrade translates into an immediate loss in value. The severe warp also adversely affects the ability to S4S the lumber. Pieces of higher MC, in the range of 13% to 19% or higher, can undergo post drying during storage and transport or in the context of structural incorporation. The post drying and associated warp fuels further economic loss and depreciates overall customer acceptance of the product. Drying to a lower average MC and narrower range in MC, while minimizing warp, should produce both higher economic return and customer satisfaction.

In the drying of contemporary lumber, essentially all moisture movement must take place perpendicular to the grain. This causes steep MC gradients within the boards that result in severe drying stresses. The increased drying stresses typically result in increased warpage.

Most of the dimension lumber produced is utilized for framing in which loading is perpendicular to a narrow edge. For softwood dimension lumber used as floor joists, rafters, door headers, etc. the major strength requirement is bending strength for loading perpendicular to the narrow edge. The use of wider pieces, e.g. the nominal 10 and 12 inch widths for floor joists, headers etc., has decreased rather dramatically over the past 2 or more decades. One factor contributing to the decreased use of wide dimension lumber is the harvesting of smaller trees. A second and equally important reason is the unreliable dimensional stability of the currently produced solid lumber. Recent commentary states that nearly 90 percent of floors for new homes in California use engineered I-Joists rather than solid lumber and then goes on to say that in a survey of U.S. building contractors lack of "straightness" was what made them least satisfied with solid lumber.

Bending strength is understood to be highly dependent on the moment of inertia, commonly designated as "I". For a rectangular cross section, the I value is determined as:

$$I=bd^3/12$$

in which b=breadth and d=depth. For a seasoned, nominal S4S 2×12, the I value is:

$$I=1.5\text{ inches}\times(11.25\text{ inches})^3/12=178\text{ inch}^4$$

When used as a floor joist e.g. the stress in bending equals the bending moment times d/2 divided by the I value. The dominating effect of I value upon stress is quite apparent.

The cross section of a selected engineered wood I-joist has the following dimensions: depth=11 inches, top and bottom flanges each 2.5 inches wide by 1.4 inches deep, and the web member of 3 layer plywood is 0.35 inches thick with a clear span depth of 8.2 inches. Its numerical I value is 178 $inches^4$. As shown above, the numerical I value for a seasoned nominal 2×12 is 178 $inches^4$. The engineered I-joist thus appears designed to replace the 2×12, doing so with only 60% of the cross sectional area of the 2×12.

Improved drying both within and between individual lumber pieces has been long desired. Some pretreatments, such as presteaming or prefreezing, have proved beneficial for certain species. However, these are difficult and expensive for incorporation into the contemporary production lines common for construction lumber.

SUMMARY OF THE INVENTION

The invention is a new and unique processing technique for framing lumber that significantly improves its drying while simultaneously enhancing its structural capability. The technique involves placing stability-kerfs perpendicular to the length of the green board, preferably on both wide faces, in a way that does not significantly alter the edge-wise bending strength of the board but so as to expose significant end grain throughout the length of the board, so that the majority of drying can substantially occur through the end-grain exposed by the stability-kerfs rather than nearly only through the side grain. The invention amplifies end grain contribution in a manner that greatly improves the drying behavior of the lumber while enhancing its future performance as a structural component. After drying, the lumber can be S4S, with the stability-kerfs visible after the S4S treatment.

While the above-identified figures set forth preferred embodiments, other embodiments of the present invention are also contemplated, some of which are noted in the discussion. In all cases, this disclosure presents the illustrated embodiments of the present invention by way of representation and not limitation. Numerous other minor modifications and embodiments can be devised by those skilled in the art which fall within the scope and spirit of the principles of this invention.

DETAILED DESCRIPTION OF PREFERRED EMBODIMENTS

Figure 1:
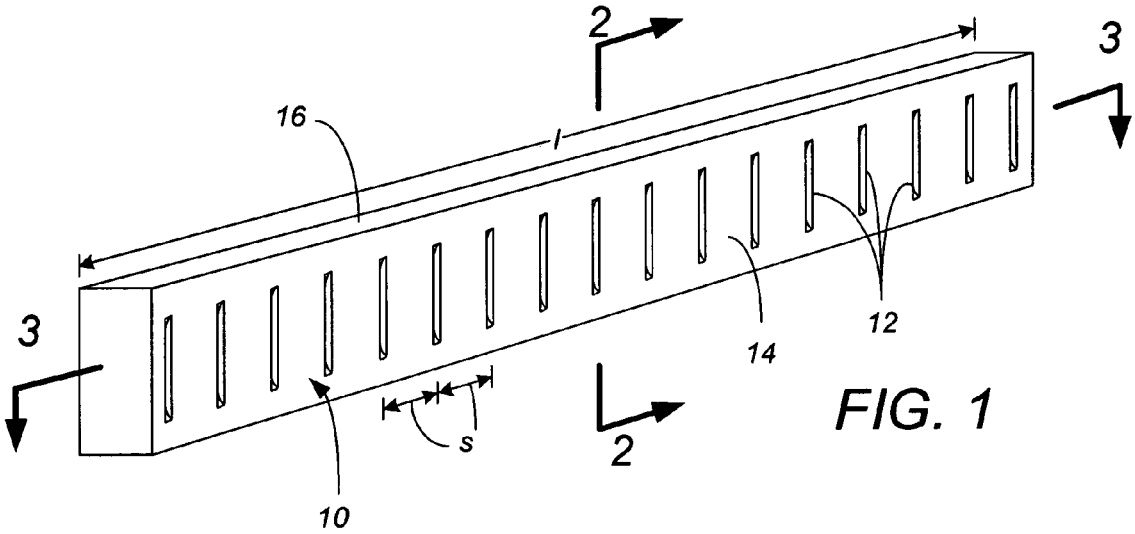
FIG. 1 is a perspective view of a nominal 2×4 board (prior to S4S) showing a preferred stability-kerfing profile of the present invention.
Figure 2:
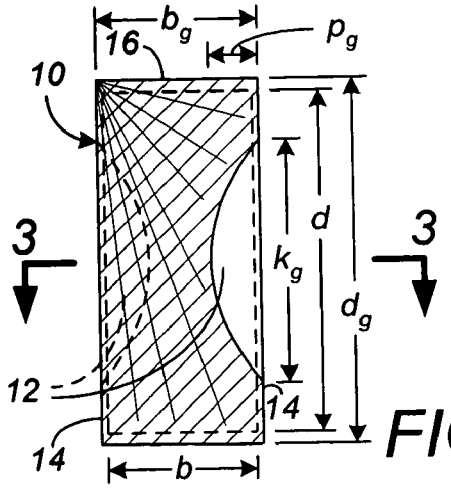
FIG. 2 is a cross-sectional view of the board of FIG. 1 taken along lines 2-2.
Figure 3:
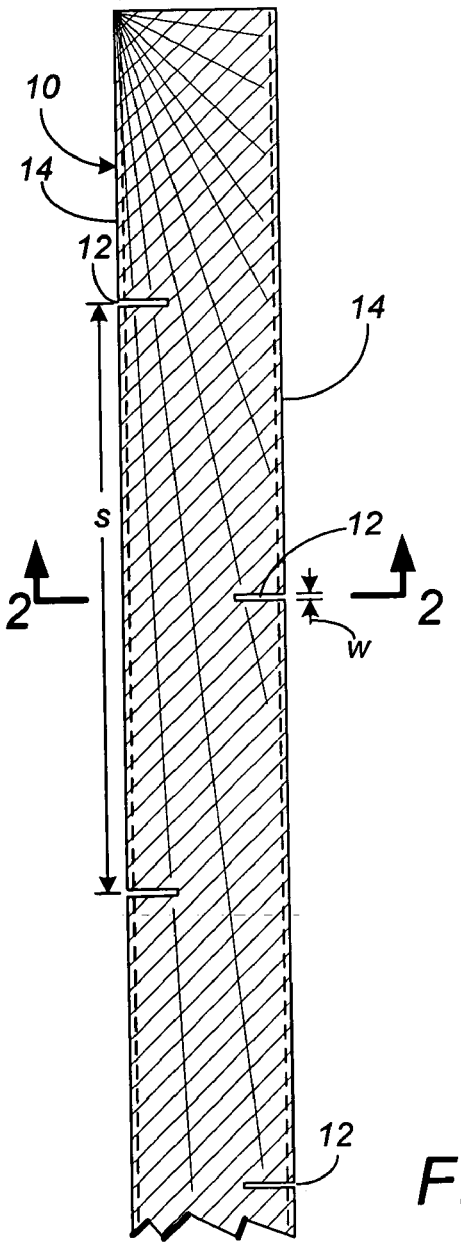
FIG. 3 is a cross-sectional view of the 2×4 board of FIGS. 1 and 2 taken along lines 3-3.

FIGS. 1-4 depict the present invention embodied in a 2×4 board 10. The board 10 has a length l, a green thickness $b_g$ and a green width $d_g$. As depicted in FIG. 1, the board 10 has a length l which is ten or more times its green thickness $b_g$. Various lengths of such framing lumber, e.g. 8', 10', 12', etc. are marketed and used in construction. The board 10 depicted in FIG. 1 is particularly shown such at a length l of about 100 inches, but the invention is equally applicable to all board lengths in which the length of the board is significantly greater than its thickness. As depicted in FIGS. 1-3, green width $d_g$ and thickness $b_g$ for the board 10 is about 3.75 inches and 1.65 inches respectively. This green thickness $b_g$ and width $d_g$ compensates for shrinkage during drying plus an allowance for the final S4S of FIG. 4 to a final width d of 3.5 inches and a final thickness b of 1.5 inches, represented by the dashed outline in FIGS. 1-3. Stability-kerfs 12 are added along the wide faces 14 of the board 10.

The spacing s between adjacent stability-kerfs 12 should be selected based upon the relative permeabilities of the board 10 along the grain versus across the grain. For a board 10 of 1.65 inches in thickness $b_g$, the maximum cross-grain distance that moisture has to travel to dry the board 10 is about 0.82 inches. The stability-kerfs 12 should be spaced commensurately. For instance, if moisture in the type of wood (such as red pine) travels 15 to 20 times faster with the grain than across the grain, the stability kerfs 12 should be spaced no more than 30 to 40 times 0.82 inches, i.e., the maximum spacing s between adjacent stability-kerfs 12 should be less than 32.8 inches, so the longest distance moisture need travel with the grain to exit the board is 16.4 inches. Such a spacing ensures that moisture has generally has a quicker route of travel leaving the board 10 through the end grain exposed by the stability-kerf 12 than through the face 14 of the board 10. In fact, the direction of moisture travel depends upon permeabilities in both directions (along grain versus across grain) and moisture level gradients in both directions at each location within the board 10, and is thus not easily modeled. The intent of the stability-kerfs 12 is to expose as much end grain as possible for air flow and drying through the stability-kerfs 12 while not significantly reducing the strength of the board 10. Because the stability-kerfs 12 do not extend all the way through the board 10 but rather expose only part of the end grain, spacing stability-kerfs 12 a distance significantly less than 32.8 inches apart provides significant drying advantages. A preferred value for the spacing s of the stability-kerfs 12 is in the range of 2 to 18 inches, with a more preferred spacing range being from 3 to 6 inches. For instance, adjacent stability-kerfs 12 can be longitudinally positions with a spacing s of about 6 inches from one another, so the greatest distance moisture need travel with the grain to exit the board 10 is 3 inches.

The width w of each stability-kerf 12 in the longitudinal direction of the board 10 need not be great. However, each stability-kerf 12 should be sufficiently wide to permit air flow within the stability-kerf 12 during the drying process, so moisture can be readily removed through the stability-kerf 12. So long as moisture removal through the stability-kerf 12 occurs readily, the stability-kerf 12 should be as thin as possible in accordance with the method of forming the stability-kerf 12. The preferred embodiment, the width w of each stability-kerf 12 in the longitudinal direction is the thickness of a saw-blade, about 1/10 of an inch. Using thin stability-kerfs 12 is helpful when the board 10 is used in construction, as the remainder of the board 10 provides a flat surface for nailing or screwing into, supporting overlying sheet material, etc.

The preferred stability-kerfs 12 are cut at intervals along each wide face 14, with stability-kerfs 12 on one face 14 interposed mid-length to those on the opposite face 14. For instance, with adjacent stability-kerfs 12 on one side 14 of the board 10 longitudinally spaced about 6 inches from one another, each stability-kerf 12 is spaced about 3 inches from the closest stability-kerfs 12 on the opposite face 14 of the board 10. By offsetting stability-kerfs 12 on one side 14 of the board 10 from the stability-kerfs 12 on the opposite side 14 of the board 10, the decrease in board strength caused by the stability-kerfs 12 is minimized.

To be effective, the stability-kerfs 12 must expose significant end grain for drying. For instance the stability-kerfs 12 should expose at least 10% of the end grain of the board 10. The stability-kerfs 12 can be formed, for instance, by penetration of a circular saw blade (3⅝ inch diameter) to the maximum midpoint penetration $p_g$ of ½ inch. This leaves a band of unpenetrated wood ⅝ inches thick and 1.65 inches wide along each narrow edge 16 of the board 10, with this unpenetrated wood providing the majority of the strength of the board 10. The length $k_g$ of the exposed saw stability-kerf 12 on each wide face 14 of the green board 10 is thereby 2.5 inches. The area of the end grain exposed by each stability-kerf 12 of this size is about 0.86 sq. in., compared to the 6.19 sq. in. cross-sectional area of the green board 10. That is, each stability-kerf 12 exposes about 14% of the end grain of the green board 10, with the stability-kerfs 12 from both sides 14 exposing about 28% of the end grain of the board 10.

The Wood Handbook provides a tabular summary for mechanical properties of commercially important woods. In the utilization of most framing lumber, the strength property of greatest concern is modulus of rupture (MOR) in edgewise static bending. The MOR is defined in psi, i.e. pounds of stress per inch$^2$. The formula for determining the stress is:

$$S = \frac{MC}{I}$$

where S=stress in psi, M=bending moment in inch-pounds, C=mid-depth in inches of the bending member and I=moment of inertia in inches to the 4th power, i.e. (inches)$^4$. The moment of inertia I for a rectangular member in bending is determined as follows:

$$I = \frac{bd^3}{12}$$

where b=thickness of the member and d=depth of the member. The importance of depth (board width d) to the value of moment of inertia I is apparent from its being raised to the 3rd power. Thus, for a given load in edgewise bending, the larger the moment of inertia I, the lower the stress. To achieve the greatest drying benefit with the minimum loss in moment of inertia I, the stability-kerfs 12 should be positioned as much as possible in the center of the wide faces 14 and away from the narrow faces 16 of the board 10.

Figure 4:
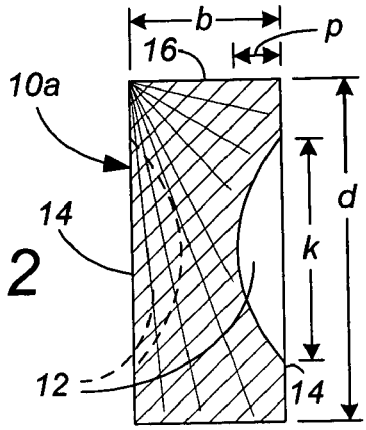
FIG. 4 is an end view of the board of FIGS. 1-3 after S4S.

An analysis of moment of inertia can be done for the cross-sectional view of the stability-kerfed, dried S4S board 10*a* depicted in FIG. 4. For a standard (unkerfed), nominal 2×4 S4S board, $I_S$=1.5(3.5)$^3$/12=5.36 inches$^4$. Even if both stability-kerfs 12 on opposite board faces 14 are aligned with each other (and thus stability kerfs 12 on both sides 14 subtract from the moment of inertia I), the stability-kerfed S4S board 10*a* shown in FIG. 4 still has a moment of inertia $I_K$=4.70 inches$^4$. That is, the ratio of $I_K$ to $I_S$, in the preferred stability-kerfed S4S board 10*a* depicted in FIG. 4 is about 0.88.

Figure 5:
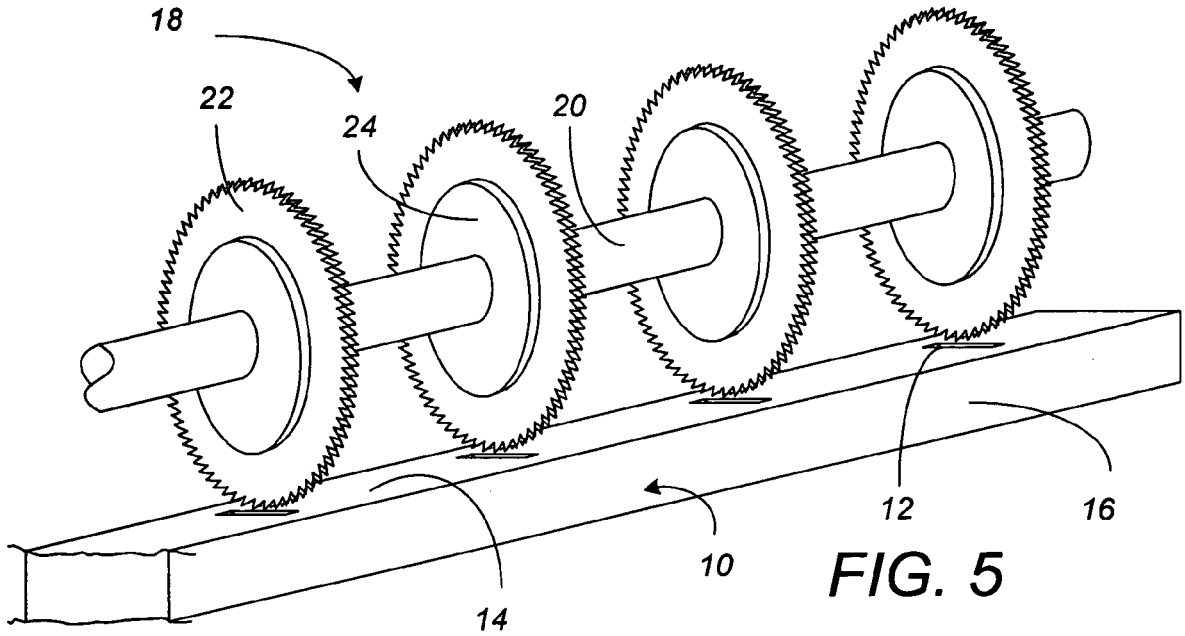
FIG. 5 is a perspective view depicting the method of the present invention.

Stability-kerfing in accordance with the present invention can easily be added to the conventional processing line common to the production of lumber. One preferred kerfing device 18 is illustrated in FIG. 5. A long saw arbor 20 is fitted with a plurality of kerf sawblades 22 spaced at the selected interval s. The saw arbor 20 should be sufficiently long to extend over substantially the entire length l of the boards 10 being processed. For example, for stability-kerfing of 100 inch long boards 10, the saw arbor 20 should extend over about 96 inches. A blade stiffener 24 is provided for each blade 22, though the blade stiffeners 24 may alternatively be omitted if experience shows they are unnecessary. In the preferred processing line, the kerfing device 18 is added at a station immediately after the headrig. With the board 10 firmly held in straight configuration, the saw assembly 18 moves downward and the blades 22 penetrate the wide face 14 of the board 10 to a desired mid-point depth p of the stability-kerf 12. The saw assembly then quickly retracts to an upward location while the board 10 is flipped 180° about its longitudinal axis for quick stability-kerfing of the opposite wide face 14. If the stability-kerfs 12 are to be offset on the two wide faces 14 of the board 10, then the board 10 when flipped should be moved longitudinally, such as the 3 inch offset. An alternative is to have two saw assemblies 18, one for each wide face 14. Simultaneous stability-kerfing of both wide faces 14 can be thereby accomplished without rotation or flipping of the board 10.

Figure 6:
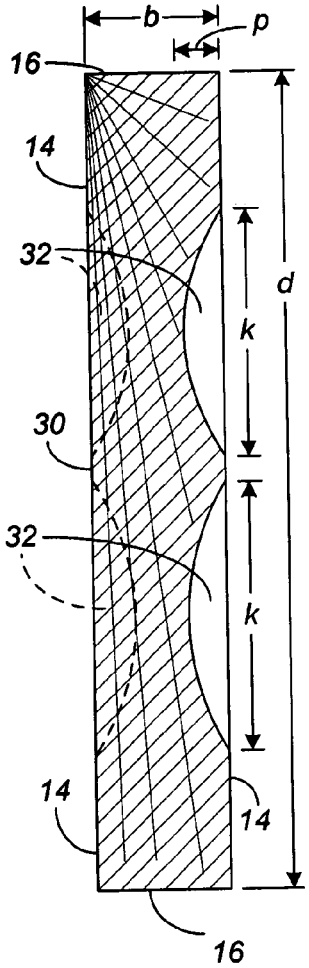
FIG. 6 is a cross-sectional view similar to FIG. 2 but of a 2×10 stud (after S4S) showing an alternative preferred stability-kerfing profile of the present invention.
Figure 8:
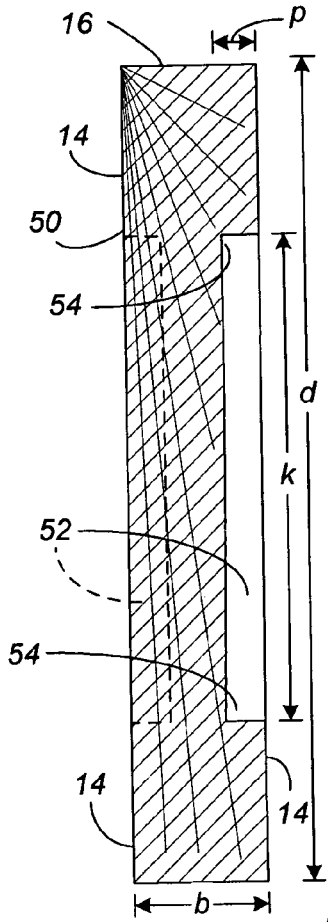
FIG. 8 is an end view of a third alternative preferred stability-kerfing profile.
Figure 7:
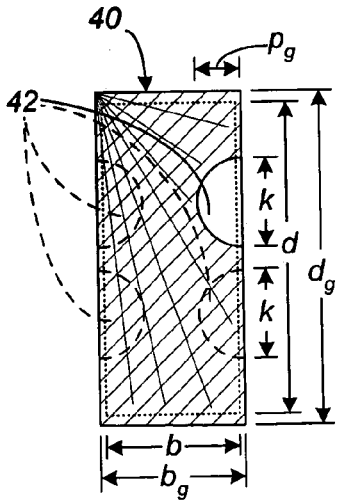
FIG. 7 is a cross-sectional view of a second alternative preferred stability-kerfing profile.

FIGS. 6-8 show alternative embodiments of the present invention. In FIG. 6, the stability-kerfing is applied in a nominal 2×10 board 30 with a double-arbor arrangement and 5½ inch diameter blades. The two arbors are part of one assembly (not shown) that moves vertically similar to the single arbor arrangement 18 as described earlier with respect to FIG. 5.

FIG. 7 depicts stability-kerfs 42 in a profile as formed in a nominal 2×4 board 40 from use of circular sawblades of 1¼ inch diameter mounted on 2 parallel arbors incorporated into one assembly (not shown). The four near half-circle stability-kerfs 42 shown create an amount of end grain nearly identical to the stability-kerfs 12 shown in FIG. 1. The stability-kerfing of both wide faces 14 can be realized by having one two-arbor assembly (not shown) and flipping the board 180°, or having two assemblies (not shown), one for each wide face 14 of the board 40. The stability-kerfing could also be formed by using a single arbor assembly 18, applied four times (two for each wide face 14) to the board 40 at desired locations. If a two-arbor assembly is used, it is preferred that the blades on one arbor be located midway to the spacing of the blades on the second arbor on the assembly, so the stability-kerfs 42 on a single nominal 4 inch face 14 of the board 40 alternate between "high" and "low" when the board 40 is oriented as shown in FIG. 7. In the most preferred arrangement, only one stability-kerf 42 is positioned at any single longitudinal location on the board 40, and thus FIG. 7 depicts three of the stability-kerfs 42 hidden in dashed lines at the particular cross-section shown.

One alternative to circular sawblades 22 used to create the stability-kerfs 12, 32, 42 depicted in FIGS. 1-7 is the use of saber sawing to create stability-kerfs 52 such as shown in FIG. 8. Saber sawing permits the formation of right angle corners 54 to the stability-kerfs 52. A sequence of saber-type blades can be mounted in an assembly (not shown) whereby a single arbor actuates the sequence of blades in unison. The assembly is then powered to move perpendicular to board length l for the desired length k and depth p of the individual cuts 52. An alternative to movement of the saw assembly is to move the board horizontally for the desired distance. If a right-angle 54 at each end of the kerf 52 is not desired, the extension of the saber saws can alternatively be controlled to produce a curvilinear penetration during both ingress and regress of the saber-type sawblades.

FIG. 8 particularly depicts a cross-sectional view of a stability-kerfed nominal 2×10 inch piece 50 of framing lumber, kerfed by saber-sawing, in its dried, S4S condition. The actual dimensions are 1.5 inches in thickness b by 9.25 inches in depth (width d). In the green, unseasoned condition the actual dimensions in thickness $b_g$ and depth $d_g$ were close to 1.65 inches and 9.75 inches respectively. After being dried to about 10% MC, the preferred stability-kerf profile produces stability-kerfs 52 with a length k of 5.45 inches long and a depth p of 0.4 inches, centered in alternating locations on opposing wide faces 14 of the board 50. The moment of inertia I value for the solid cross section of the nominal 2×10 is $$I_S = \frac{(1.5'')(9.25'')^3}{12} = 98.9 \text{ inches}^4.$$

The moment of inertia I value for the stability-kerfed cross section is obtained by subtracting from the 98.9 inches$^4$ the moment of inertia contribution or I value lost in the parts of the cross section penetrated by kerfing. The lost value is approximated as follows: The I value $$\text{lost} = \frac{(0.4'')(5.45'')^3}{12} = 5.4 \text{ inches}^4.$$

Thus, if the stability-kerfs 52 on opposing sides 14 of the board 50 are spaced sufficiently relative to the load that a rupture location only includes one stability-kerf 52, the kerfed moment of inertia $I_K$ value is 98.9 inches$^4$−5.4 inches$^4$=93.5 inches$^4$. If the stability-kerfs 52 on opposing sides of the board 50 are close enough together that the rupture location includes both stability-kerfs 52, then a smaller moment of inertia I is appropriate. The worst case scenario is to model the stability-kerfs 52 on opposing sides 14 of the board 50 as being aligned at the same longitudinal location, so the board strength matches that of a milled, wooden I beam. In this case, the kerfed moment of inertia $I_K$ value is: $I_K$=98.9 inches$^4$−10.8 inches$^4$=88.1 inches$^4$. The worst-case ratio of $I_K$ to $$I_S = \frac{88.1 \text{ inches}^4}{98.9 \text{ inches}^4} = 0.89.$$

Thus the stability-kerfed 2×10, if for example used as a floor joist, should have 89 percent the bending strength of what it would have unkerfed. However, the strength values for wood increase with decreasing MC, which can cause the stability-kerfed 2×10 to have a higher bending strength than that calculated by merely comparing moments of inertia I.

The present invention can be equally applied to other dimensions of boards. For a nominal 2×12 member the actual dry S4S dimensions are 1.5 inches thick (b) by 11.25 inches wide (d). If the 2×12 were routed on each wide face 14 in rectangular manner, leaving flanges 1.5 inches wide by 2.5 inches deep and a web 0.5 inches thick, the numerical I value for the cross section is 178−20.2~158 inches$^4$. This is nearly 90% of that for the solid 2×12 and the engineered I-joist. With a rectangular shaped kerf (preferably produced by saber-sawing, though it could also be obtained by routing), and at a kerf depth p of 0.4 inches and a kerf length l of 6.75 inches in the S4S board, the ratio of $I_K$ to $I_S$ for the nominal 2×12 is 0.90. Thus, to attain an $I_K$ to $I_S$ ratio in the dried lumber of about 0.90, the preferred depth $p_g$ of each kerf should approximate 25 to 30% of the green thickness $b_g$ with the preferred length $k_g$ equal to 60 to 65% of green board width $d_g$. Using roughly these percentages, and making the comparison at equal MC's, will result in a framing member with essentially 90% of the edgewise bending strength it would have as a solid cross section framing member. Wood is anisotropic and comes in different species, and the most-preferred kerf dimensions should be selected as appropriate for particular samples and species of boards.

While the 90% $I_K$ to $I_S$ ratio is appropriate for analyzing boards in edgewise bending, the manner of use of the kerfed board is not limited to edgewise bending. Many 2×4's are used in framing lumber either in vertical arrangements (typically supporting a compressive load like a column), or in horizontal arrangements wherein the wide face is oriented horizontally. The preferred 2×4 of FIGS. 1-4 is equally appropriate for such uses. Due to the increased straightness and dryness of the boards, kerfed 2×4s may be less likely to fail than unkerfed 2×4s even in such vertical and horizontal loading arrangements. If it is known that a board will be loaded in facewise bending, stability kerfs may be placed upon the narrow faces of the board rather than on the wide faces of the board. Another example is with lumber such as nominal 4×4s and 6×6s, which can be very difficult to dry without inducing warpage. For such square boards, the kerfs can be placed upon two opposing faces, or can be placed in all of the four faces of the boards.

Figure 9:
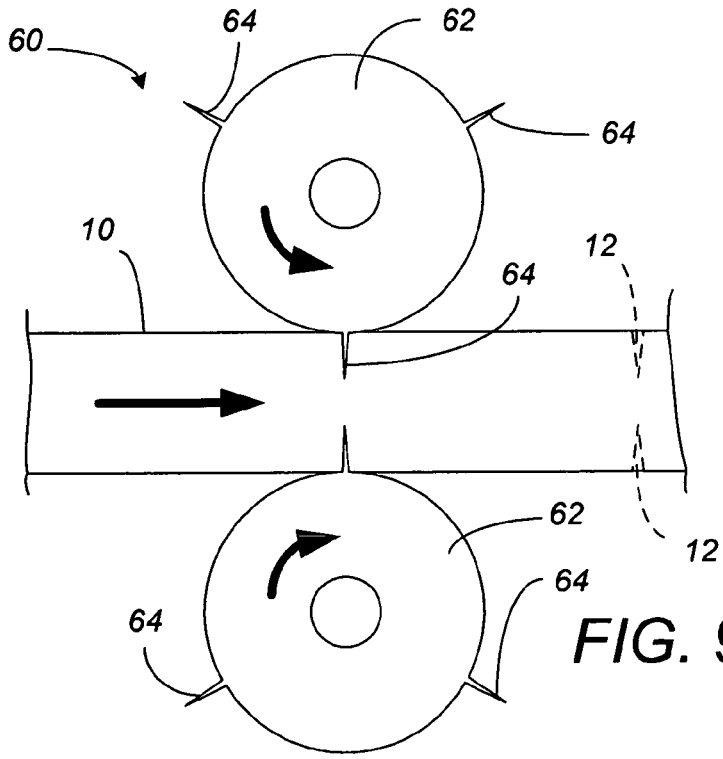
FIG. 9 is an elevational view of an alternative method of forming stability-kerfs of the present invention.

As an alternative to either circular or saber sawing, the stability-kerfs of the present invention can be formed by a roller incisor 60 as depicted in FIG. 9. Two steel rollers 62 have three high strength tapered blades 64 mounted parallel to the roller length. The rim speed of the rollers 62 is synchronized with the in-line speed of the advancing board 10, so the incisor blades 64 experience primarily resistance to board penetration and not a severe bending moment. The blades 64 make incisions at the selected interval s perpendicular to the grain on the respective wide faces 14 of the board 10. For instance, for nominal 2×4 boards the blades can be 2 inches in length (k) and ½ inch in depth (p). The blades 64 make incisions centered on the wide faces 14 of the 2×4 board 10, leaving a non-incised band on the narrow edges of the board 10 which is 0.85 inches wide. This kerfing profile again provides an $I_K$ to $I_S$ of approximately 0.90.

An alternative to a roller incisor is a pressure incisor (not shown) similar in design to that for saw kerfing of FIG. 5.

The saw arbor is replaced by a non-deformable strip of steel having incisor blades of the desired length k, depth p and spacing s, such as 2 inches in length ½ inch in depth and at 3 inch spacing. With the freshly sawn board held in place in a straight configuration, the incising "ram" or press thrusts downward to cut the stability kerfs. If a single ram is employed, the board is flipped to receive stability-kerf incisions on the opposite wide face 14. More preferably, the board is pressed between opposing rams to incise both wide faces simultaneously, which facilitates removal of the board from the press. Both the roller incisor and the pressure incisor can be properly modified to accommodate boards of any standard length l or width d.

Table 1 is copied from the Wood Handbook: Wood as an engineering material, Agric. Handbook. 72. USDA 1987.

TABLE 1

Approximate middle trend effects of moisture content on mechanical properties of clear wood at about 20° C.

| Property | Relative change in property from 12 percent moisture content: At 6 percent moisture content | At 20 percent moisture content |
|---|---|---|
| Modulus of elasticity parallel to the grain | +9 | −13 |
| Modulus of elasticity perpendicular to the grain | +20 | −23 |
| Shear modulus | +20 | −20 |
| Bending strength | +30 | −25 |
| Tensile strength parallel to the grain | +8 | −15 |
| Compressive strength parallel to the grain | +35 | −35 |
| Shear strength parallel to the grain | +18 | −18 |
| Tensile strength perpendicular to the grain | +12 | −20 |
| Compressive strength perpendicular to the grain at the proportional limit | +30 | −30 |

Table 1 gives the approximate effects of MC on the mechanical properties of clear wood at a temperature of 20° C. Strength values are normally obtained at a wood MC of 12% and a wood temperature of 20° C. The Wood Handbook table gives the relative change for each property in going from 12% MC down to 6% (strength increase) and for a change from 12% to 20% MC (strength decrease). Of immediate interest are the relative changes for bending strength. The approximate increase in strength for each percent decrease in MC is 5 percent. The approximate decrease in strength for each percent increase in MC is more than three percent.

The Southern Yellow Pine (SYP) species as a group are a large contributor to the production of framing lumber. The Wood Handbook gives the modulus of rupture ("MOR") at 12% MC for Longleaf Pine as 14,500 psi. In contemporary processing, SYP species are commonly kiln dried to an average MC of 15%. Thus its average MOR entering the market chain at 15% MC is 14,500 psi minus the strength loss due to having a MC of 15% rather than 12%. The loss calculates to 1359 psi. The 14,500 psi, minus 1359 psi, results in a MOR value of 13,141 psi. For those pieces at the upper end of the MC distribution, a MC of 19% or even greater, the loss in strength due to the additional MC is truly significant. At 19% MC the bending strength is reduced to 11,328 psi. On the other hand, if the drying were to a 10% average MC, the bending strength is 14,500 psi plus 906 psi which equals 15,406 psi. The ability to efficiently dry to lower and more uniform MC's with stability-kerfing more than compensates for the approximate ten percent loss in bending strength resulting from decrease in moment of inertia.

EXAMPLE 1

Forty red pine boards, 20 controls and 20 stability-kerfed as depicted in FIGS. 1-4, were dried as one charge in a steam heated experimental lumber dry kiln. Sixteen of the full length boards, 8 stability-kerfed and 8 controls, (all boards≅100 inches long) served as sample boards to be weighed periodically during the kiln run. The dry bulb temperature was maintained at 192° F. throughout the kiln run while the wet bulb temperature tracked at about 173° F.

Figure 10:
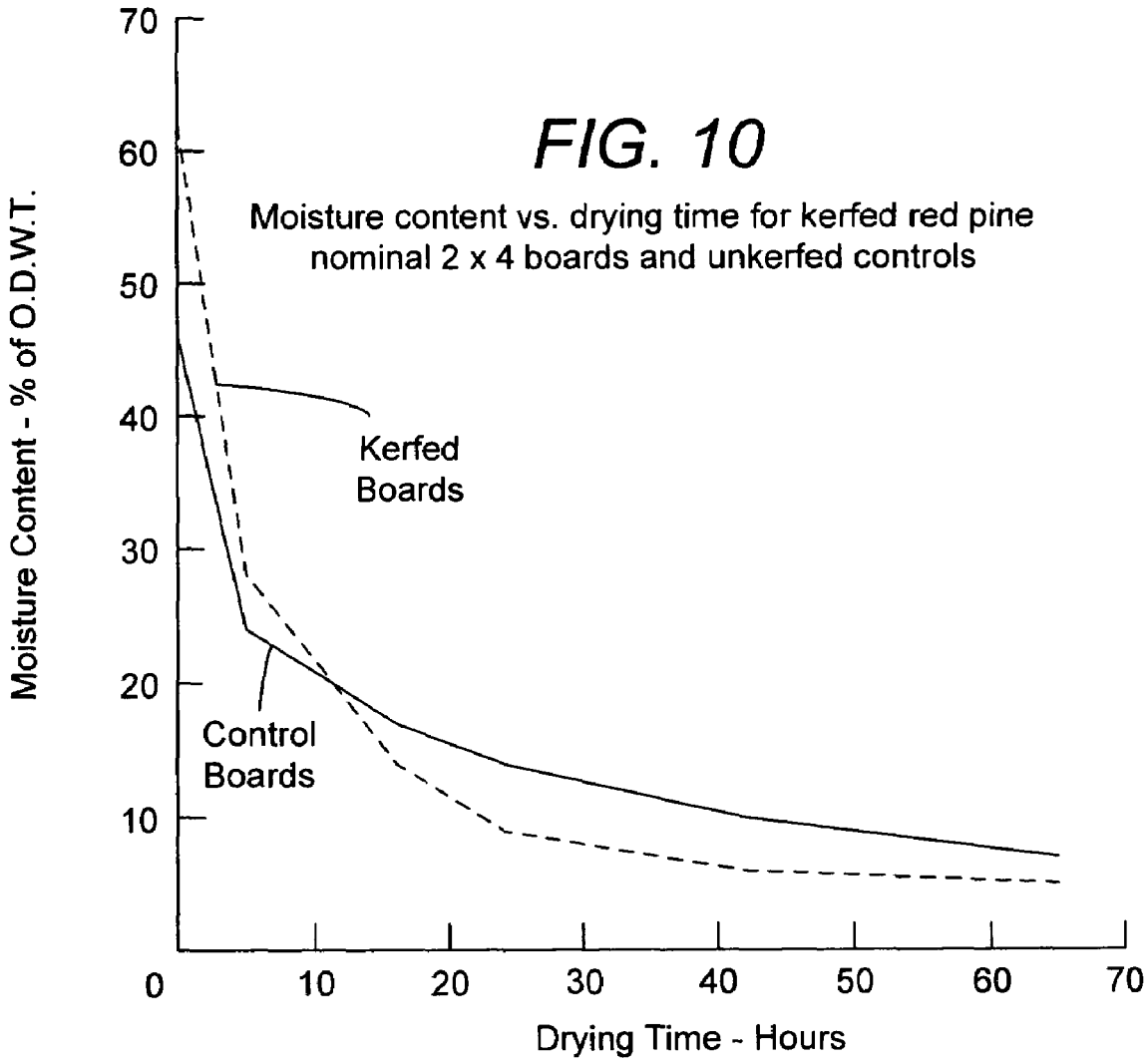
FIG. 10 is a graph of moisture content versus drying time for studs stability-kerfed in accordance with the preferred stability-kerfing profile of FIGS. 1-4, shown relative to standard 2×4 control boards.

FIG. 10 compares drying rates for stability-kerfed and controls. Accelerated drying due to stability-kerfing is readily apparent. Stability-kerfed boards, even though higher in initial average MC, reached 10% MC in about 23 hours while for the controls this required over 41 hours. This stability-kerfing design created a 45% reduction in the time required for reaching a highly desired level of final MC. The 10% average MC is in good agreement with the equilibrium moisture content (EMC) the lumber will seek during subsequent storage, transportation, marketing and final end-use structural applications. At 10% average MC the range in MC for the 8 stability-kerfed boards was 7.6% to 11.8% while for controls at their 10% average it was 7.9% to 11.5%. The similarity in range shows that the 45% faster drying did not unfavorably increase the range in MC.

Table 2 below summarizes warp data for the 40 boards, comparing warp values of boards stability-kerfed in accordance with the preferred stability-kerfing profile of FIGS. 1-4 relative to standard 2×4 control boards. Each warp form was measured to the nearest 1/32 inch.

TABLE 2

Warp Comparisons - Controls vs. Kerfed - No Restraint

| | Controls - Avg. MC 8.8% | Kerfed - Avg. MC 7.9% |
|---|---|---|
| | Number Of Boards Meeting Stud Grade | |
| Crook | 10 (50%) | 17 (85%) |
| Bow | 20 (100%) | 20 (100%) |
| Twist | 4 (20%) | 3 (15%) |
| | Average Amount of Warp | |
| Crook | 0.27 in. | 0.11 in. |
| Bow | 0.15 in. | 0.06 in. |
| Twist | 0.59 in. | 0.65 in. |

The average absolute amounts of crook and bow for the stability-kerfed boards were less than half of those for the controls, even though the stability-kerfed had a lower average MC of 7.9% compared to 8.8% for controls. With respect to meeting stud grade, using crook as the criterion, only 10 of the 20 controls made stud grade while for the stability-kerfed 17 made grade. With bow as the criterion, all 20 of each met grade. Due to the high allowance of the grading rule for bow, all controls made grade in spite of having over twice the average amount of bow as that for stability-kerfed. For twist, the absolute amount for both stability-kerfed and controls was very high and the grade recovery for each was very low. In a small kiln charge of only 40 boards there is a negligible dead weight of lumber to restrain warp. In this experimental drying with the near absence of restraint, stability-kerfing produced more than a two-fold reduction in absolute crook and bow but had no benefits for twist. In a commercial kiln charge twist would be greatly reduced for both stability-kerfed and controls due to dead-weight loading.

Table 3 summarizes the strength-testing data obtained for the 20 stability-kerfed and 20 unkerfed red pine boards.

TABLE 3

Strength And Moisture Data Obtained In The Determination Of Bending Strength In Edgewise Centerpoint Loading Of Nominal 2 × 4 Kerfed And Unkerfed Boards At A Clear Span Of 82 Inches Strength Data in Edgewise Bending

| | No. of Studs | Average Peak Load lb. of Force | Range of Peak Loads lb. of Force | Avg. Extension at Peak Load inches | Average MOE psi |
|---|---|---|---|---|---|
| Kerfed | 20 | 709 | 1295-143 | 1.612 | 949,170 |
| Controls | 20 | 745 | 1228-409 | 2.161 | 823,277 |

Moisture Content* at Time of Strength Testing

| | No. of Studs | Average MC of Boards - values in % | Range of Average % MC values | Range of % MC Values Obtained for Shells | Range of % MC Values Obtained for Cores |
|---|---|---|---|---|---|
| Kerfed | 20 | 9.7 | 9.2-10.9 | 8.2-9.5 | 9.2-10.6 |
| Controls | 20 | 10.2 | 9.6-10.9 | 9.0-11.6 | 9.5-11.7 |

*Calculated as a percentage of the constant weight obtained at a drying temperature of 220° F.

The average breaking force for edgewise bending in pounds of force was 709 for the stability-kerfed boards and 745 for the controls. The ratio of stability-kerfed to controls is 0.95, considerably higher than the 0.88 "worst-case scenario" value estimated earlier. The elevated value likely arises for two reasons. The first is that in making the estimate the kerfed regions were treated as rectangles while in reality the actual kerfs left wood that contributed to the moment of inertia I value. Secondly, as Table 3 shows, the average MC for the stability-kerfed at time of strength testing was lower than that for the controls and this also contributed to higher strength. The lower and more uniform MC for kerfed also translated into a 15% higher modulus of elasticity for kerfed than for controls. The greater stiffness is well evidenced by the average extension at peak load for kerfed being only 75% of that for controls.

The present invention thus attains the following results:

1. The use of end grain creation via stability-kerfing in green dimension lumber to greatly accelerate its drying to the desired low and uniform moisture content while simultaneously reducing the warp that commonly accompanies the drying.
2. The created end grain diminishes just slightly the moment of inertia and thus the lumber retains its ability for use as structural lumber with no inhibition to nail, screw or adhesive use.
3. The slight reduction in strength due to the stability-kerfing is more than recaptured due to the ease in achieving a lower and more uniform final moisture content than that attained in contemporary commercial practice.
4. The unique use of stability-kerfing for end grain creation will greatly enhance the treatability of lumber with preservatives and the post-treatment removal of the vehicle employed.
5. Recognition of a variety of stability-kerfing designs that can reduce the drying time for green lumber to the final desired moisture condition to one-half of that required for comparable unkerfed lumber.
6. Innovative design of sawing equipment for quick and efficient stability-kerfing of lumber.
7. The use of end grain creation in green dimension lumber to reduce drying time, energy requirements and warp for large batches of lumber such as in a kiln.
8. The creation of a technique which when incorporated into the drying process for green lumber produces a dimensionally stable product free of significant distortion during subsequent storage, marketing and structural applications.

The stability-kerfing technique of the present invention thus increases the contribution of end-grain drying and greatly reduces drying time and also improves uniformity of final MC within and between pieces, and thereby improves the overall recovery and grade of dried lumber from a given input of logs.

Although the present invention has been described with reference to preferred embodiments, workers skilled in the art will recognize that changes may be made in form and detail without departing from the spirit and scope of the invention.

The invention claimed is:

1. A method of treating lumber, comprising:

processing stability-kerfs into unseasoned rectangular boards to expose end grain at a plurality of locations along the length of each board, wherein a cross-section of each unseasoned rectangular board taken at each stability-kerf has an area of less than 90% of the full cross-sectional area of the board, wherein the rectangular boards have a thickness b which is less than their width h, with the width defining a vertical orientation of the board, and wherein a cross-section of each unseasoned rectangular board taken at each stability-kerf has moment of inertia $I_{xx}$ in the vertical orientation which is at least $bh^3/18$;

drying the stability-kerfed boards to at least S-Dry; and surfacing the dried stability-kerfed boards on four sides.

2. The method of claim 1, wherein the surfacing is carried out to a S4S depth, and wherein the stability-kerfs extend past the S4S depth.

3. The method of claim 1, wherein the stability kerfs are positioned within at least one face of the rectangular boards, such that the exposed end grain does not intersect an edge of the rectangular boards.

4. The method of claim 1, wherein the stability-kerfs are positioned along two opposing faces of the rectangular boards.

5. The method of claim 4, wherein the stability-kerfs are positioned at alternating longitudinal locations on the opposing faces of the rectangular boards.

6. The method of claim 1, wherein the rectangular boards have a thickness which is less than their width, and wherein the stability-kerfs are exposed on the wide sides of the rectangular boards.

7. The method of claim 1, wherein the stability-kerfs are formed by cuts partially through each rectangular board.

8. The method of claim 7, wherein the cuts each define a circular arc.

9. The method of claim 1, wherein the stability kerfs are positioned from two to twenty four inches apart along the length of each rectangular board.

10. The method of claim 1, wherein the unseasoned rectangular boards have a thickness b, and wherein the stability kerfs are positioned no more than 10*b* apart along the length of each rectangular board.

11. The method of claim 1, wherein the drying occurs under pressure to help maintain unwarped straightness of the boards.

12. A method of treating lumber, comprising:

processing stability-kerfs into unseasoned rectangular boards to expose end grain at a plurality of locations along the length of each board, with each stability-kerf extending partially through the unseasoned rectangular board, wherein a cross-section of each unseasoned rectangular board taken at each stabilitv-kerf has an area of less than 90% of the full cross-sectional area of the board, wherein the rectangular boards have a thickness b which is less than their width h, with the width defining a vertical orientation of the board, and wherein a cross-section of each unseasoned rectangular board taken at each stabilitv-kerf has moment of inertia $I_{xx}$ in the vertical orientation which is at least $bh^3/18$; and drying the stability-kerfed boards to at least S-Dry.

13. The method of claim wherein the stability kerfs are positioned within at least one face of the rectangular boards, such that the exposed end grain does not intersect an edge of the rectangular boards.

14. The method of claim 12, wherein the stability-kerfs are positioned along two opposing faces of the rectangular boards.

15. The method of claim 14, wherein the stability-kerfs are positioned at alternating longitudinal locations on the opposing faces of the rectangular boards.

16. The method of claim 12, wherein the act of processing stability-kerfs comprises sawing stability-kerfs into the unseasoned rectangular boards.

17. The method of claim 1, wherein the act of processing stability-kerfs comprises sawing stability-kerfs into the unseasoned rectangular boards.

* * * * *